US006619935B1

(12) United States Patent
Kluth et al.

(10) Patent No.: US 6,619,935 B1
(45) Date of Patent: Sep. 16, 2003

(54) MIXING VALVE WITH AXIALLY SEGMENTED STATOR WINDINGS FOR AXIALLY POSITIONING A CONTROL ELEMENT FOR CONTROLLING THE FLUID CONNECTION BETWEEN INLETS AND OUTLETS

(75) Inventors: Hans-Ulrich Kluth, Weil im Schonbuch (DE); Wolfgang Muller, Schonaich (DE)

(73) Assignee: Honeywell AG, Offenbach (DE)

( * ) Notice: Subject to any disclaimer, the term of this patent is extended or adjusted under 35 U.S.C. 154(b) by 0 days.

(21) Appl. No.: 10/048,301

(22) PCT Filed: Jul. 18, 2000

(86) PCT No.: PCT/EP00/06841

§ 371 (c)(1),
(2), (4) Date: Jul. 9, 2002

(87) PCT Pub. No.: WO01/07836

PCT Pub. Date: Feb. 1, 2001

(30) Foreign Application Priority Data

Jul. 24, 1999 (DE) ..... 199 34 819

(51) Int. Cl.[7] ..... F04B 35/04

(52) U.S. Cl. ..... 417/423.1; 417/423.14; 417/423.11; 417/424.1; 417/423.7; 417/366; 137/331; 137/625.4

(58) Field of Search ..... 417/423.1, 423.14, 417/423.11, 424.1, 423.7, 366; 137/331, 625.4

(56) References Cited

U.S. PATENT DOCUMENTS

| | | | | |
|---|---|---|---|---|
| 3,915,351 A | * | 10/1975 | Kiralfy | 222/385 |
| 4,080,112 A | * | 3/1978 | Zimmermann | 417/420 |
| 4,465,091 A | * | 8/1984 | Keller | 137/243.6 |
| 5,597,009 A | * | 1/1997 | Scherrer et al. | 137/375 |
| 5,713,729 A | * | 2/1998 | Hong | 417/423.14 |
| 5,816,784 A | * | 10/1998 | Postuchow et al. | 417/423.11 |

FOREIGN PATENT DOCUMENTS

DE 2107000 * 8/1972

* cited by examiner

*Primary Examiner*—Charles G. Freay
*Assistant Examiner*—Emmanuel Sayoc

(57) ABSTRACT

The invention relates to a mixing valve with at least two inlets and at least one outlet. A control element is configured as a pump wheel controls the fluid connection between the inlets and the outlets. The pump wheel is connected to a hollow shaft which is rotated by an electric motor and axially displaced through selective actuation of axially displaced stator segments. In a fist axial position of the pump wheel, a first inlet is communicated with the outlet and a second inlet is shut off, and in a second axial position the second inlet is communicated with the outlet and the first inlet is shut off. In a third an intermediate axial position, the two inlets communicate with the outlet allowing fluid mixing within a pump chamber. In a further embodiment of the device, the pump wheel includes a rotatable member to impel fluid through the pump chamber and the outlet. The device unites the mixing valve and the circulation pump in one fitting.

20 Claims, 6 Drawing Sheets

MIXING VALVE WITH AXIALLY SEGMENTED STATOR WINDINGS FOR AXIALLY POSITIONING A CONTROL ELEMENT FOR CONTROLLING THE FLUID CONNECTION BETWEEN INLETS AND OUTLETS

BACKGROUND OF THE INVENTION

The present invention relates to a mixing valve used in heating plants to influence the temperature of the water in a heater.

Mixing valves, and particularly three-way mixing valves, are used in heating plants for establishing a controlled connection between the forward flow of the heater and the forward flow of the boiler or the back flow of the heater, respectively, e.g. in order to influence the temperature of the water in the forward flow of the heater by adding water of the back flow of the heater. Then, as a rule, a circulation pump moving the heating medium through the plant is arranged in the forward flow of the heater.

BRIEF SUMMARY OF THE INVENTION

Starting out from this, it is the object of the present invention to unite the mixing valve and the circulation pump in one fitting. The solution of this problem is achieved according to the characterizing features of the independent claims. Further advantageous embodiments of the fitting according to the invention can be gathered from the dependent claims.

BRIEF DESCRIPTION OF THE DRAWINGS

The invention shall be described in greater detail in the following by means of the embodiments shown in the figures of the enclosed drawing.

DETAILED DESCRIPTION OF THE INVENTION

Figure 1:
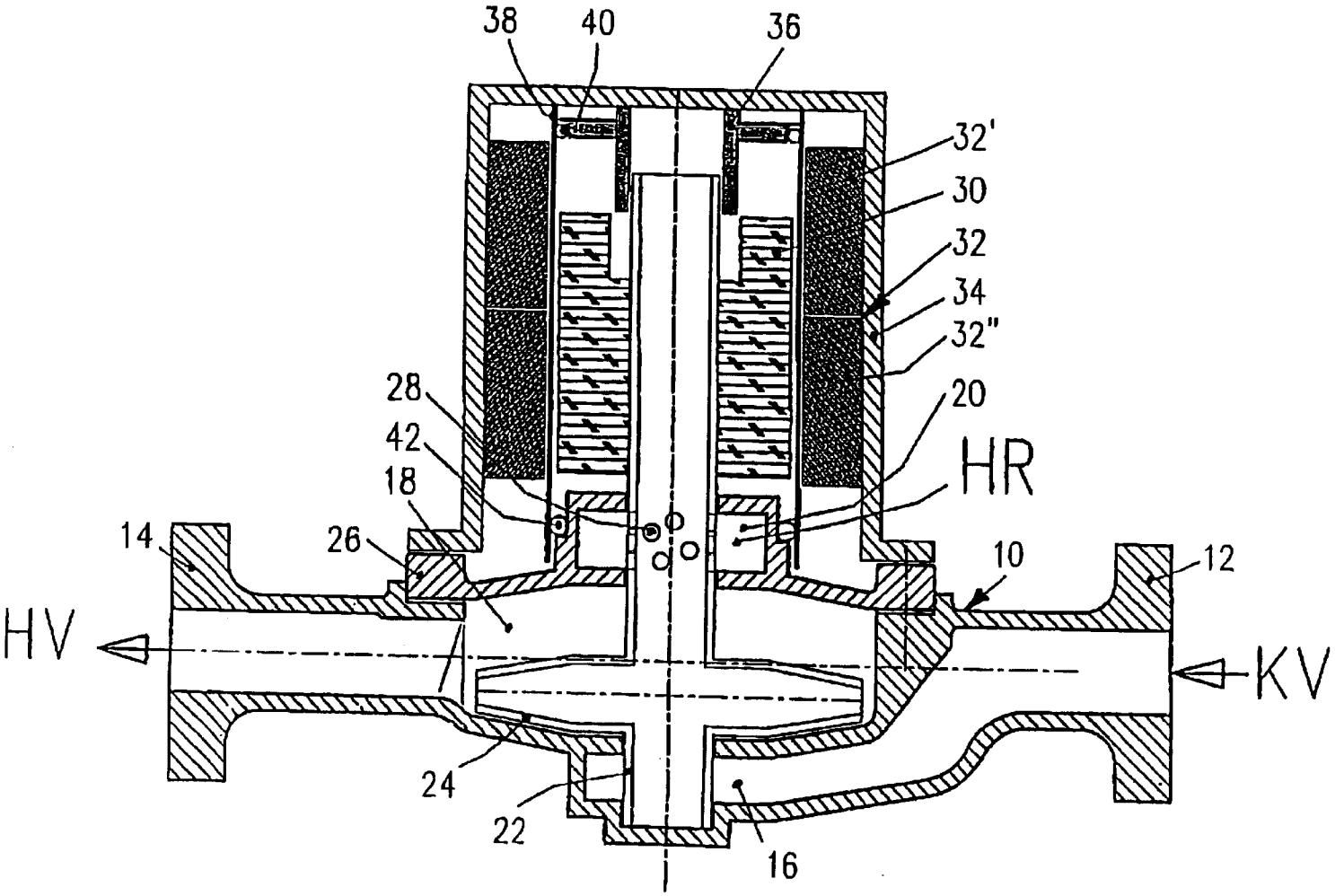
FIG. 1 shows the fitting according to the invention according to a first embodiment in a position in which the back flow of the heater is connected to the forward flow of the heater.

According to FIG. 1, a mixing valve housing 10 comprises an inlet nozzle 12 for the forward flow of the boiler, an outlet nozzle 14 for the forward flow of the heater and an inlet nozzle for the back flow of the heater, the latter not being visible in this representation. The inlet nozzle 12 is connected to a lower chamber 16, the forward flow of the heater is connected to a middle chamber 18, and the back flow of the heater is connected to an upper chamber 20. All chambers 16, 18, and 20 are communicated with each other via bore holes aligned with each other. A hollow and axially displaceable shaft 22 passes through these bore holes and supports a pump wheel 24 in the area of the middle chamber 18. The upper chamber 20 is arranged on a housing lid 26 which, upon its removal, allows the insertion of the pump wheel 24 including the hollow shaft 22 into the middle chamber 18. In the position shown in FIG. 1, the hollow shaft 22 abuts with its open lower end on the bottom of the lower chamber 16 and, thus, blocks the access of the forward flow of the boiler into the pump wheel 24 and the middle chamber 18. On the other hand, the perforations 28 in the hollow shaft 22 in the area of the upper chamber 20 establishes a connection between the back flow of the heater and the pump wheel 24 or the middle chamber 18, respectively.

The hollow shaft 22 projects upwards from the upper chamber 20 and is connected to the rotor 30 of a motor whose stator winding 32 is arranged in a cup-shaped housing 34 which is flange-mounted on the housing lid 26. The stator winding 32 is axially divided into two windings 32' and 32" for achieving different positions of the rotor 30 and, thus, of the hollow shaft 22 by the separate or simultaneous excitation of the windings 32', 32". In the case shown in FIG. 1, only the lower winding 32" is excited for driving the pump wheel 24 via the rotor 30 and the hollow shaft 22, the excitation being, however, sufficient for achieving the requested pumping efficiency.

An inlet 36 concentrically mounted to the interior of the lid area of the cup-shaped housing 34 serves to guide the hollow shaft 22. A sleeve 38 which is sealed off against the inlet 36 and against a top element at the housing lid 26 via 0-rings 40 and 42 shields the stator winding 32 against the flowing medium. The pressurized areas of the control element consisting of the pump wheel 24 and the hollow shaft 22 are selected such that they have the same'size and permit a pressure balance.

Figure 2:
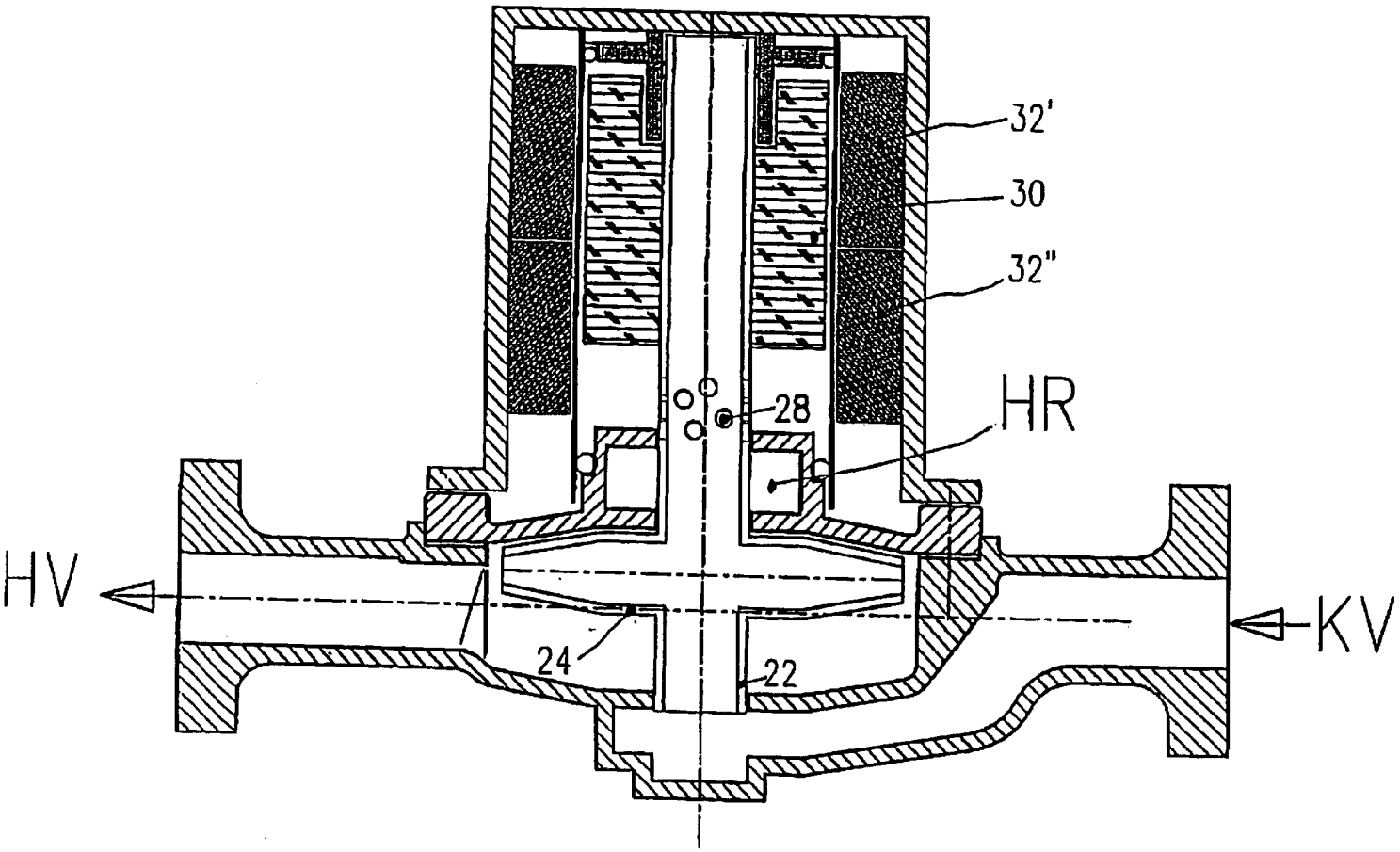
FIG. 2 shows the fitting according to the invention according to FIG. 1 in a position in which the forward flow of the boiler is connected to the forward flow of the heater.

FIG. 2 shows a position of the mixing valve having an integrated circulation pump where the forward flow of the boiler is connected to the forward flow of the heater and the addition of the' back flow of the heater is separated. This position is achieved by the excitation of the stator winding 32' alone; thereby, the rotor 30 is drawn into the same, so that the lower end of the hollow shaft 22 releases the unhindered access of the forward flow of the boiler to the pump wheel 24 and the perforations 28 are situated on a level where no connection with the back flow of the heater is established any more.

Figure 3:
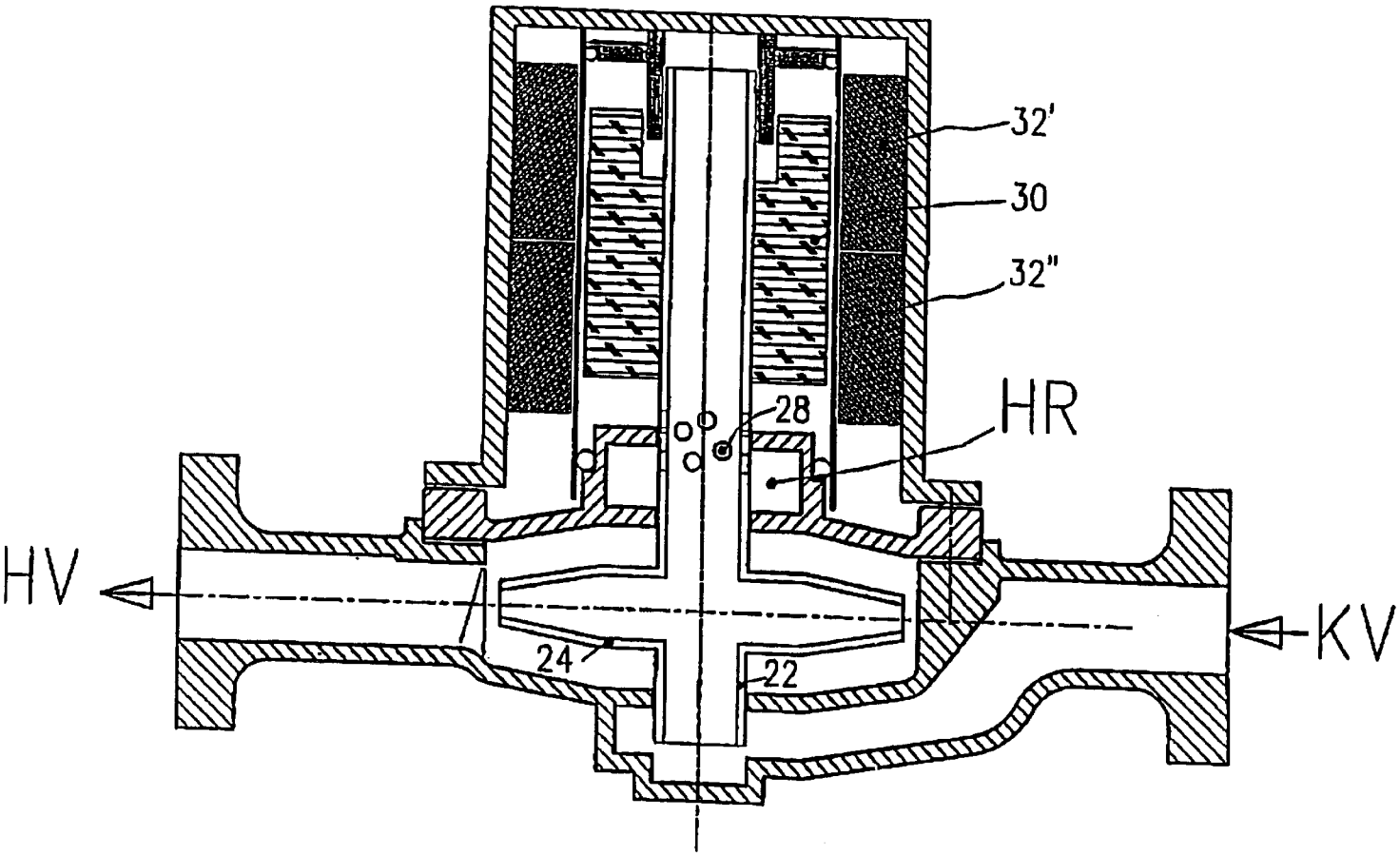
FIG. 3 shows the fitting according to the invention according to FIG. 1 in an intermediate position in which the forward flow of the boiler and the back flow of the heater are connected to the forward flow of the heater.

FIG. 3 shows the position of the mixing valve having an integrated pump, in which the forward flow of the boiler as well as the back flow of the heater are connected to the forward flow of the heater. This position is achieved by the excitation of both stator windings 32' and 32" whereby the rotor 30 takes up a central position, so that the lower end of the hollow shaft 22 allows the partial access of the forward flow of the boiler and the perforations 28 are situated on a level at which a connection with the back flow of the heater is at least partially established.

Figure 4:
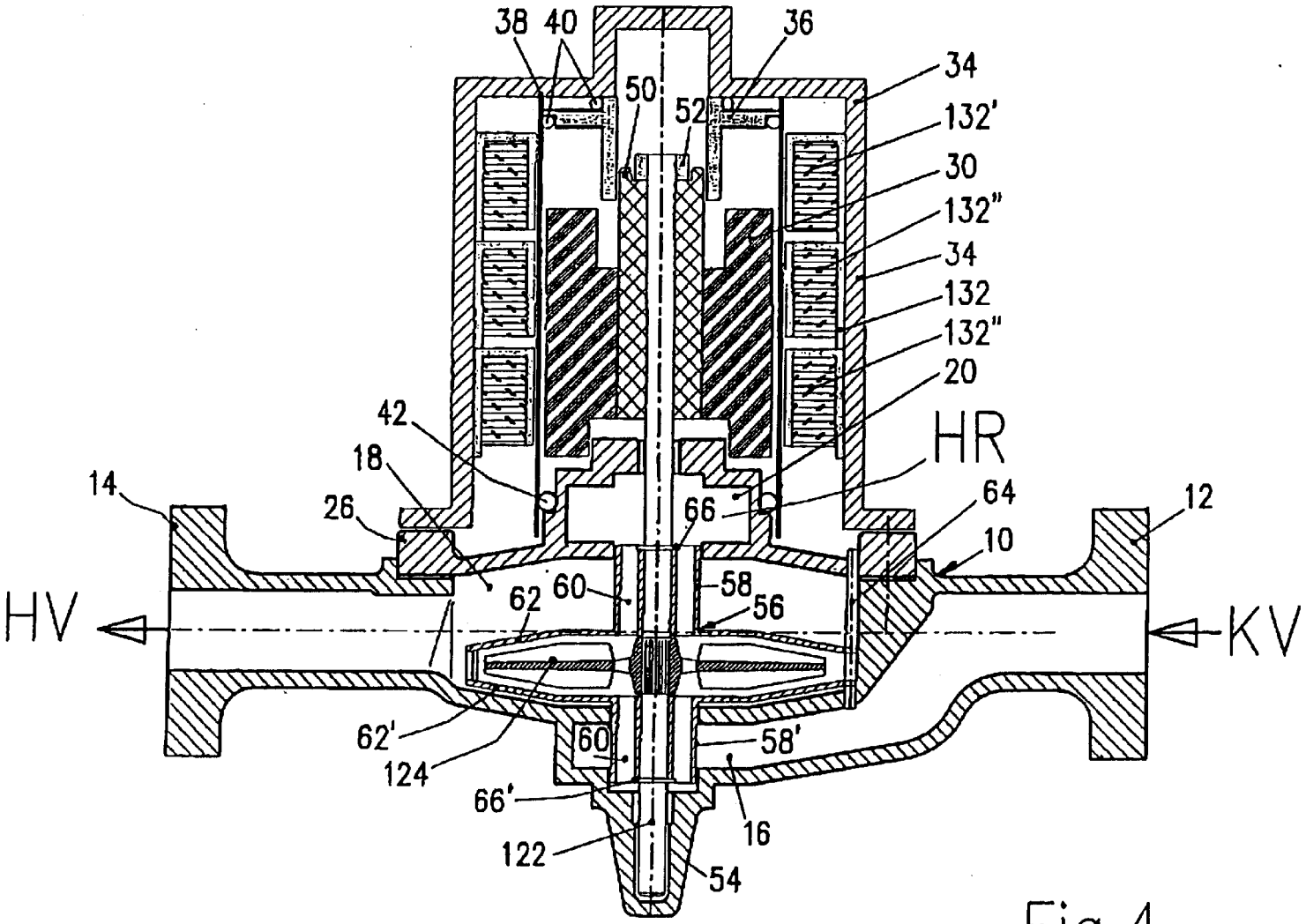
FIG. 4 shows the fitting according to the invention according to a second embodiment, in which the back flow of the heater is connected to the forward flow of the heater.
Figure 5:
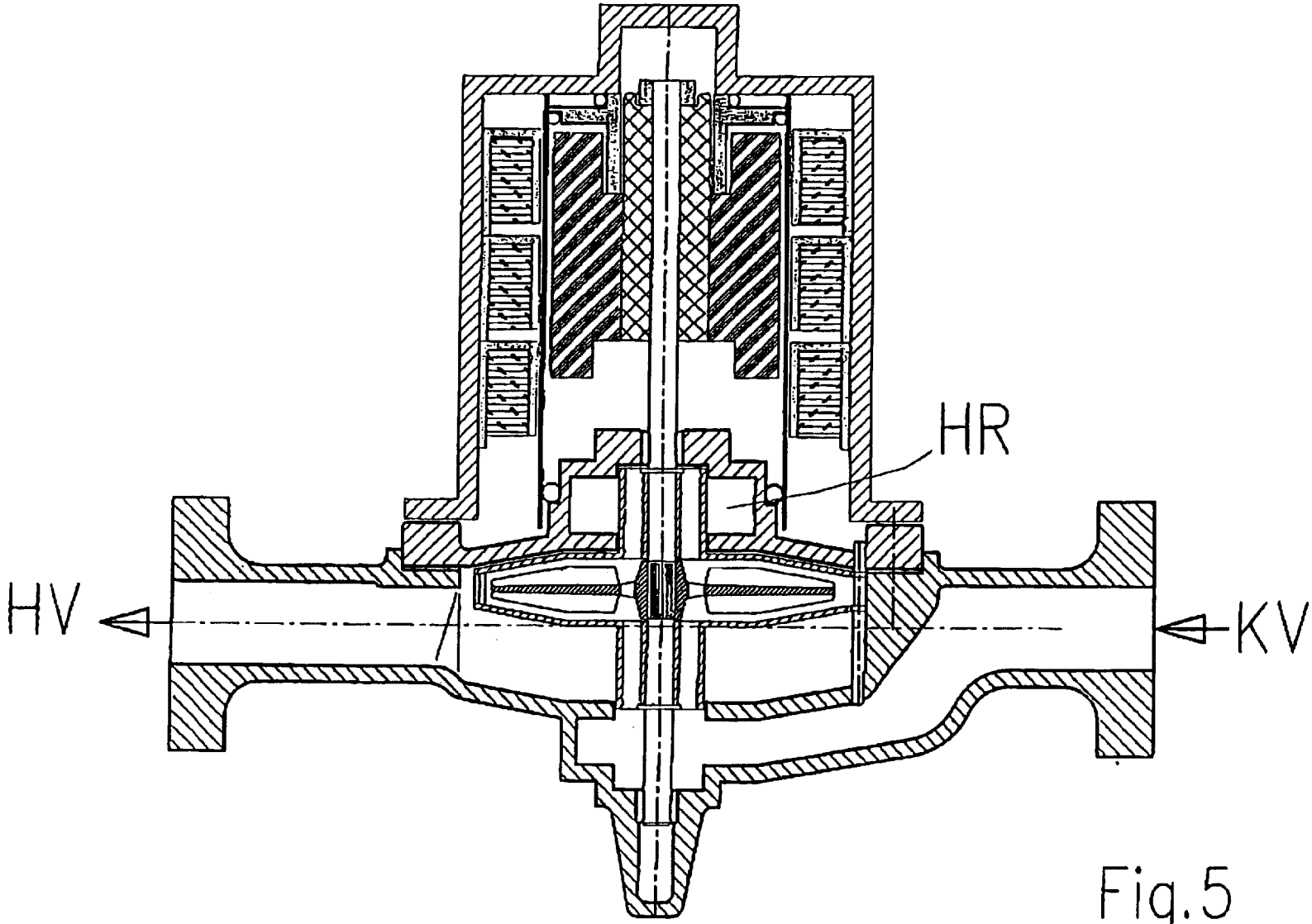
FIG. 5 shows the fitting according to the invention according to FIG. 4, in which the forward flow of the boiler is connected to the forward flow of the heater.
Figure 6:
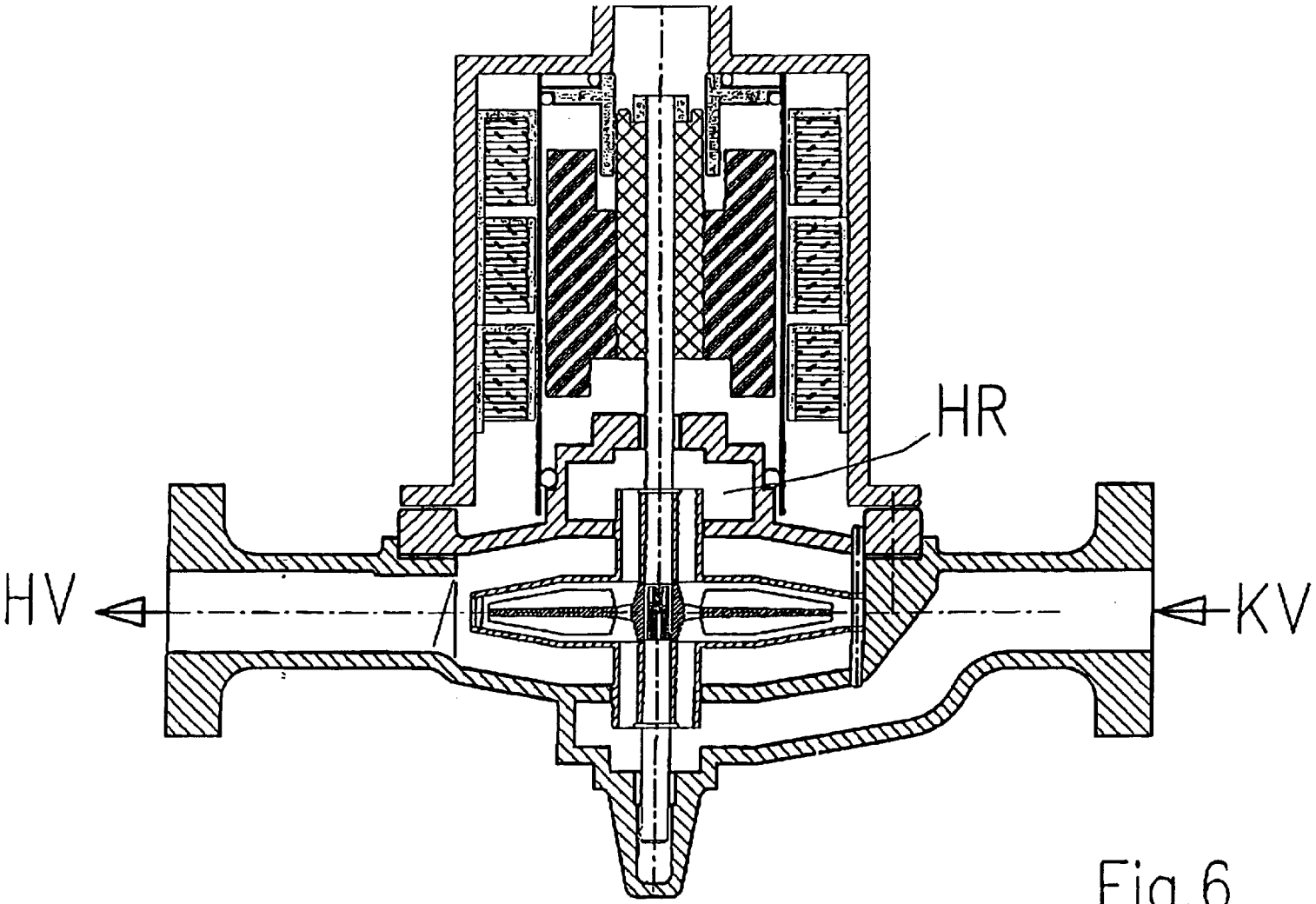
FIG. 6 shows the fitting according to the invention according to FIG. 4, in which the forward flow of the boiler and the back flow of the heater are connected to the forward flow of the heater.

The further embodiment of the invention shown in FIGS. 4 to 6 shall only be described in so far as it differs from the embodiment shown in FIGS. 1 to 3. The same components are provided with the same reference signs; a "1" has been placed in front of functionally modified components, and new components have been provided with separate reference signs.

According to FIG. 4, the stator 132 of the motor comprises three stator windings 132', 132" and 132'" arranged one above the other, the rotor 30 being adapted to take up different positions by the separate or joint excitation of the stator windings 132', 132" and 132'", as this was also the case for the embodiment according to FIGS. 1 to 3.

The rotor 30 is connected to a motor shaft 122 by means of a nut 52 via a sleeve-shaped intermediate member 50 which does not consist of iron. The motor shaft 122 is supported in a lower housing extension 54 and, as a pump wheel, an impeller 124 is slipped onto the motor shaft 122 and is rotatable together with the same. The impeller 124 is disposed in a supporting housing 56 which works as displaceable control element and consists of two symmetrical parts between which there is the impeller 124. The supporting housing 56 comprises two cylindrical extensions 58, 58' provided with ducts 60, 60' which may e.g. be provided by bore-holes which are parallel to the axis and distributed over the circumference. In principle, the extensions 58, 58' may also be given by two concentric sleeves connected to each other via radial webs. The ducts 60, 60' form the connection between the forward flow of the boiler KV, the forward flow of the heater HV and the back flow of the heater HR, the impeller 124 effecting the transportation of the medium.

The wings of the impeller 124 extend radially over an area situated outside the medium flowing through the ducts or passages 60, 60', respectively. Two shield plates 62, 62' extending radially outwards from the cylindrical extensions 58, 58' enclose the impeller 124 between themselves, and bundle the medium passing through. The shield plates 62, 62' can be locked at a distance from each other over the circumference at different positions. Furthermore, the shield plates 62, 62' show U-shaped grooves in the edge which are aligned with each other and not recognizable here; said grooves extend over a pin 64 inserted into the housing 10, so that they are retained axially movable but not movable in the rotational direction. Locking rings 66, 66' secure the supporting housing 56 on the motor shaft 122, so that it is axially movable with the motor shaft if the stator windings 132', 132" and 132'" are excited suitably for displacing the rotor 30 and, thus, the control element.

What is claimed is:

1. A mixing valve comprising a housing, inlets and outlets on the housing, a connection between the inlets and outlets, a motor having a stator winding divided in at least three axial directions and a control element configured as a pump wheel in the housing, said control element including a shaft connected to the motor and positioned at a desired one of at least three axial positions according to the actuation of the divisions of the stator winding for controlling the connection between the inlets and outlets.

2. A mixing valve according to claim 1, wherein the shaft is hollow.

3. A mixing valve according to claim 2, wherein the hollow shaft extends at both sides of the control element in order to seal off a first inlet on the housing in a final position and to produce a connection with a second inlet via perforations in the hollow shaft.

4. A mixing valve according to claim 2, wherein the control element and the hollow shaft are integrally formed.

5. A mixing valve according to claim 4, wherein the effective pressurized surfaces of the control element consisting of the pump wheel and the hollow shaft are formed so as to be substantially similar size.

6. A mixing valve according to claim 2, wherein the housing comprises a lower chamber, which is connected to the forward flow of a boiler, a middle chamber which is connected to the forward flow of a heater, and an upper chamber which is connected to the back flow of the heater, all chambers being connected via the hollow shaft to a set of ducts which pass through separating walls between the chambers.

7. A mixing valve according to claim 6, further comprising a cup-shaped member placed onto the housing for accommodating the stator winding and the rotor of the motor.

8. A mixing valve according to claim 7, further comprising a sealing means between the stator winding and the rotor of the motor.

9. A mixing valve comprising a housing, inlets and outlets on the housing, a connection between the inlets and outlets, and a control element in the housing for controlling the connection between the inlets and outlets, wherein the control element is configured as a receiving housing for a pump wheel and is supported so as to be axially displaceable, but secured against rotation for controlling the connection between the inlets and outlets situated on different levels.

10. A mixing valve according to claim 9, wherein the receiving housing consists of two parts which are symmetrical to each other in a mirror-inverted manner and which are connected to each other and accommodate the pump wheel, said pump wheel being seated on a motor shaft rotatably supported in the receiving housing.

11. A mixing valve according to claim 10, wherein the receiving housing is guided so as to be axially displaceable and that means are provided for securing it against rotation.

12. A mixing valve according to claim 11, wherein the receiving housing comprises two shield-shaped parts from which cylindrical extensions comprising axially directed ducts extend upwards and downwards.

13. A mixing valve according to claim 12, wherein the pump wheel is formed as an impeller, with wings, said wings extend radially over an area situated outside the ducts.

14. A mixing valve according to claim 12, wherein the housing comprises a lower chamber, which is connected to the forward flow of a boiler, a middle chamber which is connected to the forward flow of a heater, and an upper chamber which is connected to the back flow of the heater, all chambers being connected via the hollow shaft to the ducts which pass through separating walls between the chambers.

15. A mixing valve according to claim 14, further comprising a cup-shaped member placed onto the housing of the mixing valve for accommodating the stator winding and the rotor of the motor.

16. A mixing valve according to claim 15, further comprising a sealing means between the stator winding and the rotor of the motor.

17. A mixing valve and circulation pump combination for use in pumping fluid from a first source, a second source, and a combination of both the first and second sources to an outlet comprising:

a hollow member movable to a first position to connect the first source to the hollow member, movable to a second position to connect the second source to the hollow member and to a third position connecting both the first and second sources to the hollow member;

a pump wheel assembly connected to said hollow member and including a chamber for receiving fluid from the hollow member and providing access to the outlet, said pump wheel assembly including a rotatable member to impel fluid through the chamber to the outlet, said pump wheel assembly moving with the hollow member so that when the hollow member is in the first position, fluid from the first source is pumped through the chamber to the outlet, when the hollow member is in the second position, fluid from the second source is pumped through the chamber to the outlet and when the hollow member is in the third position, fluid from the first and second sources is pumped through the chamber to the outlet; and, a motor having a rotor connected to rotate the rotatable member and having a stator divided into a plurality of separately energizable portions so that when a first portion of the stator is energized, the hollow member is in the first position, when a second portion of the stator is energized the hollow member is in the second position and when a third portion of the stator is energized, the hollow member is in the third position.

18. The mixing valve and circulation pump combination of claim 17 wherein the third portion of the stator comprises the first and second portions of the stator together.

19. The mixing valve and circulation pump combination of claim 17 wherein the rotatable member comprises and impeller having wings extending in the chamber.

20. The mixing valve and circulation pump combination of claim 17 wherein the outlet is the forward flow of a heater in a heating plant, the first source of fluid is the forward flow of a boiler in the heating plant, and the second source of fluid is the backflow of the heater.

* * * * *